United States Patent [19]

Mori et al.

[11] 4,429,198

[45] Jan. 31, 1984

[54] POWER SWITCHGEAR

[75] Inventors: Teijiro Mori; Shigeru Masuda, both of Amagasaki; Hiroyuki Okado, Nagoya; Masahiro Kakizoe, Nagoya; Yuji Sako, Nagoya, all of Japan

[73] Assignee: Mitsubishi Denki Kabushiki Kaisha, Tokyo, Japan

[21] Appl. No.: 380,314

[22] Filed: May 20, 1982

[30] Foreign Application Priority Data

| | | | |
|---|---|---|---|
| May 20, 1981 | [JP] | Japan | 56-77409 |
| May 20, 1981 | [JP] | Japan | 56-77410 |
| May 20, 1981 | [JP] | Japan | 56-77411 |
| May 20, 1981 | [JP] | Japan | 56-77412 |

[51] Int. Cl.[3] ..... H01H 9/30

[52] U.S. Cl. ..... 200/144 R; 335/201

[58] Field of Search ..... 200/144 R; 335/132, 335/201

[56] References Cited

U.S. PATENT DOCUMENTS

| | | | |
|---|---|---|---|
| 2,310,056 | 2/1943 | Bendz | 200/144 R |
| 2,356,039 | 8/1944 | Ellis et al. | 200/144 R |
| 4,080,520 | 3/1978 | Müller | 200/144 R |
| 4,237,355 | 12/1980 | Fenchant et al. | 200/147 R |

FOREIGN PATENT DOCUMENTS

| | | |
|---|---|---|
| 1051935 | 5/1956 | Fed. Rep. of Germany . |
| 1765051 | 7/1971 | Fed. Rep. of Germany . |
| 1765999 | 11/1971 | Fed. Rep. of Germany . |
| 2508299 | 9/1975 | Fed. Rep. of Germany . |
| 2378344 | 8/1978 | France . |

OTHER PUBLICATIONS

Pollmann, Fritz, et al., "Motor Contactors of Compact Design for the World Market," *Siemens Review,* vol. XLI, Dec. 1974, No. 12, pp. 562–566.

Aspinall, R., "How to Design A.C. Contactors for Improved Service Performance," *Electrical Review,* Apr. 2, 1971, pp. 441 to 443.

*Primary Examiner*—E. A. Goldberg

*Assistant Examiner*—Morris Ginsburg

*Attorney, Agent, or Firm*—Sughrue, Mion, Zinn, Macpeak, and Seas

[57] ABSTRACT

A power switchgear is equipped with a stationary contact and contact-maker, a movable contact and contact-maker, a commutating electrode and an arc runner. The elements are constructed and arranged such that when the contacts open, the resultant arc will be quickly driven from the contacts to the commutating electrode and arc runner, to increase the life of the contacts and shorten the arcing time.

9 Claims, 45 Drawing Figures

POWER SWITCHGEAR

BACKGROUND OF THE INVENTION

The present invention relates to a power switchgear for operating an electric circuit.

FIGS. 1–4 represent one example of a conventional power switchgear. In the drawings, 1 denotes a mounting formed of a metallic steel plate, which is provided with a plurality of fitting holes 1*a* used to arrange a power switchgear body therethrough; 2 denotes a base formed of an insulating material, which is fixed on the mounting plate 1 with a screw 3; 4 denotes a fixed core having a silicon steel plate laminated thereon. An operating coil 5 is installed on the fixed core 4, and further a leaf spring 6 is arranged in a gap with the mounting plate 1 as a shock absorber. Numeral 7 denotes a moving core arranged opposite to the fixed core 4, which is pulled toward the fixed core 4 when the operating coil 5 is conducting; 8 denotes a cross bar formed of an insulating material, which is coupled to the moving core 7 through a pin 9; 10 denotes a trip spring arranged between the cross bar 8 and the mount 1, which normally lifts the cross bar 8 so that a main circuit of the power switchgear is maintained open; 11 denotes a moving contact-maker provided with a moving contact 11*a*, which is inserted in a holding hole 8*a* provided on the cross bar 8 and urged by a pressure spring 12; 13 denotes a fixed contact-maker provided with a stationary contact 13*a* opposite the moving contact 11*a*. The fixed contact-maker 13 is fixed on a terminal 15 with a screw 14, and the terminal 15 is fixed to the base 2 with screws 16, 17. Numeral 13*b* denotes an arc runner connected electrically to the fixed contact-maker 13, which can be unified with the fixed contact-maker 13; 14 denotes a terminal screw connected to a main circuit wire, which is fitted to the terminal 15; 19 denotes an arc box formed of an insulating material, which is fixed on the base 2 with a screw 20. The arc box 19 includes a hole 19*a* through which gas is discharged, a ceiling part 19*b* and a side plate 19*c*. Numeral 21 denotes a deion grid arranged in a shape as in FIG. 4 and made of a magnetic material; 22 denotes a commutating electrode, which is fixed on the ceiling part 19*b* of the arc box 19. The stationary contact 13*a* and the moving contact 11*a* are formed in the internal space of an arc extinguishing chamber.

The operation of the power switchgear as thus arranged will now be described. When a voltage is impressed on the operating coil 5 with the main circuit shown in FIG. 1 open, a magnetic flux is generated between the fixed core 4 and the moving core 7, and the moving core 7 is moved toward the fixed core 4 against the force of the trip spring 10. In this case, the cross bar 8 coupled to the moving core 7 moves downwardly, the moving contact 11*a* of the moving contact-maker 11 comes in contact with the stationary contact 13*a* of the fixed contact-maker 13, and a predetermined pressure is applied by the pressure spring 12 to open the main circuit. Next, when the operating coil 5 is deenergized, the moving core 7 moves away from the fixed core 4 by the force of the trip spring 10, and the cross bar 8 also moves with the moving core 7. Therefore, the cross bar 8 returns to the state shown in FIG. 1, and the moving contact 11*a* of the moving contact-maker 11 and the stationary contact 13*a* of the fixed contact-maker 13 are separated. In the process, an arc is generated between the moving contact 11*a* and the stationary contact 13*a* at a portion indicated in FIG. 1 at A. The movement of the arc until the current is interrupted after it is generated is illustrated for only one side in FIG. 5, as the arc extinguishing chamber B in FIG. 1 is symmetrical. FIG. 5*a* represents the state wherein the stationary contact 13*a* and the moving contact 11*a* are closed. When the stationary contact 13*a* and the moving contact 11*a* are opened when the operating coil 5 is conducting, an arc 23 is generated, as shown in FIG. 5*b*, between the stationary contact 13*a* and the moving contact 11*a*. The contact opening distance gets larger as time passes, up to the maximum distance. The arc 23 is driven and expanded, as shown in FIG. 5*c*, by the current flowing in the moving contact-maker 11 and the fixed contact-maker 13 and the deion grid 21, and one end of the arc 23 is transferred, as shown in FIG. 5*d*, from the surface of the stationary contact 13*a* to the arc runner 13*b*. Then, there occurs a dielectric breakdown between a tip of the arc 23 shown in FIG. 5*d* and a portion of the arc runner 13*b* indicated at A, and an end of the arc 23 is transferred to the portion of the arc runner 13*b* indicated at B in FIG. 5*e*. The other end of the arc 23 is transferred, as shown in FIG. 5*f*, from the stationary contact 11*a* to the commutating electrode 22 and the arc 23 is extinguished between the deion grids 21. Thus, the current is cut off completely. As noted, the power switchgear has a commutating electrode 22 positioned on the rear side of the moving contact 11, and therefore a long time is required for one end of the arc 23 to transfer from the moving contact 11*a* to the commutating electrode 22. The shortcoming that the expensive moving contact 11*a* is subject to wear is consequently unavoidable.

SUMMARY OF THE INVENTION

An object of the present invention is therefore to decrease the wear of the moving contact, in an apparatus of this type.

Barring a different arrangement of the commutating electrode, the power switchgear according to the invention is identical to that of FIGS. 1–4. In the power switchgear according to the invention, the position of a tip 22*a* of the commutating electrode 22 is set so that Y (the shortest distance between the tip 22*a* of the commutating electrode 22 and the arc runner 13*b*) will be smaller than X (the shortest distance between the moving contact 11*a* and the arc runner 13*b*, when the contact opening distance exceeds a given value.

DETAILED DESCRIPTION OF THE PREFERRED EMBODIMENTS

Figure 1:
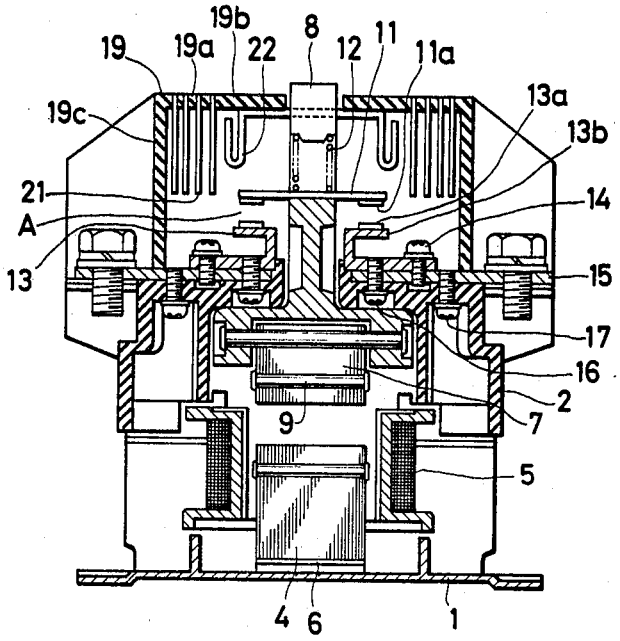
FIG. 1 PRIOR ART
FIG. 1 is a sectional view representing a conventional-type power switchgear.
Figure 2:
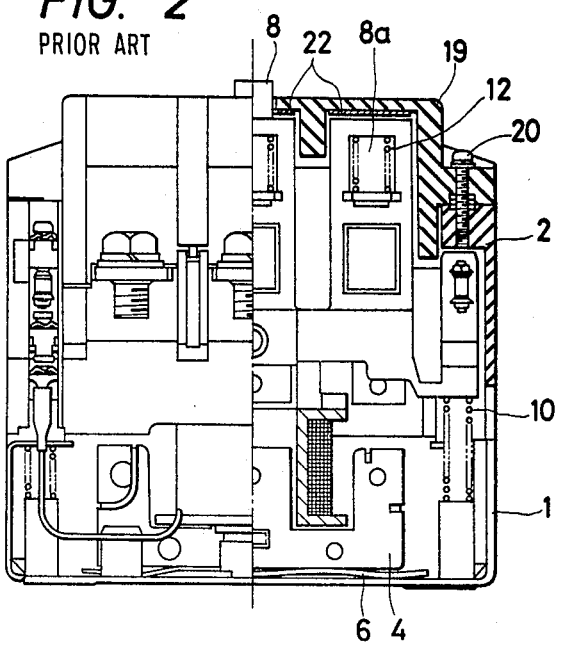
FIG. 2 PRIOR ART
FIG. 2 is a side view of the equipment of FIG. 1.
Figure 3:
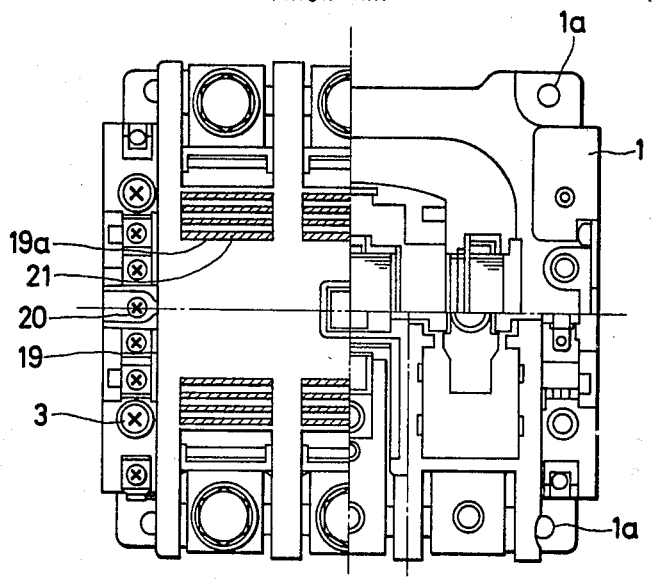
FIG. 3 PRIOR ART
FIG. 3 is a plan view of the equipment of FIG. 1.
Figure 4:
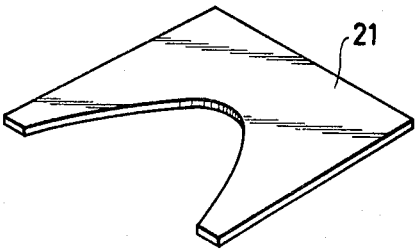
FIG. 4 PRIOR ART
FIG. 4 is a perspective view of the deion grid of FIG. 1.
Figure 5A:
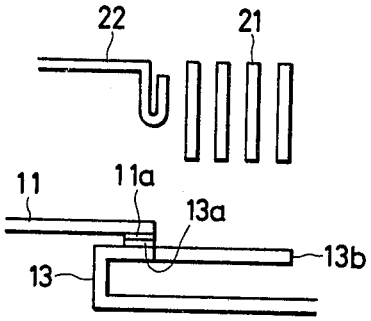
FIG. 5(a) PRIOR ART
FIGS. 5*a*–5*f* are explanatory drawings showing the arc extinguishing chamber of a conventional type-power switchgear, and the movement of the arc.
Figure 5D:
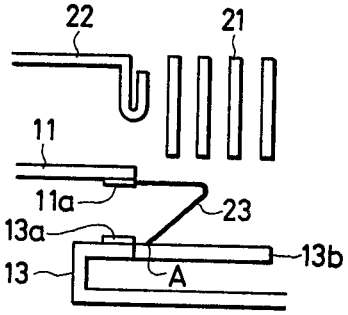
FIG. 5(d) PRIOR ART
Figure 5B:
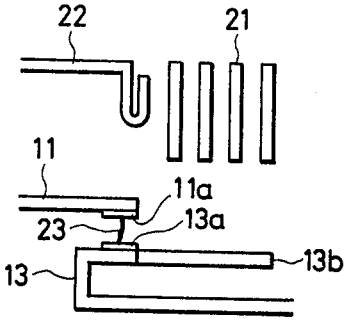
FIG. 5(b) PRIOR ART
Figure 5E:
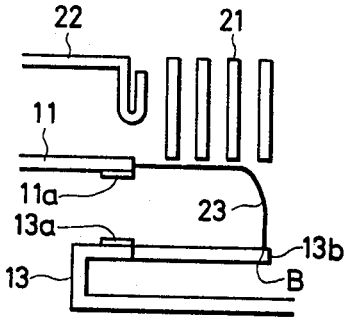
FIG. 5(e) PRIOR ART
Figure 5C:
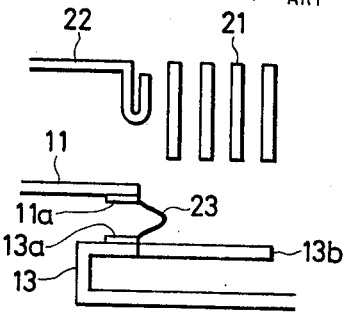
FIG. 5(c) PRIOR ART
Figure 5F:
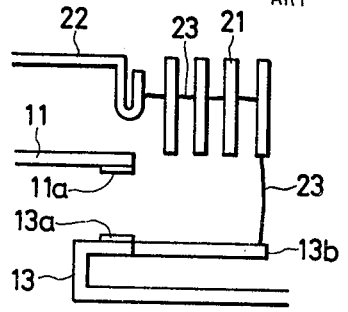
FIG. 5(f) PRIOR ART
Figure 6A:
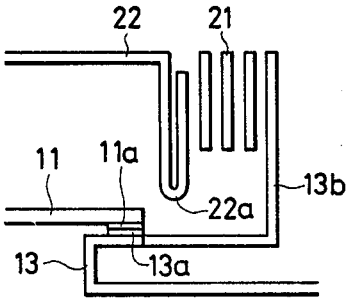
FIGS. 6*a*–6*f* are structural drawings representing one embodiment of the invention.
Figure 6D:
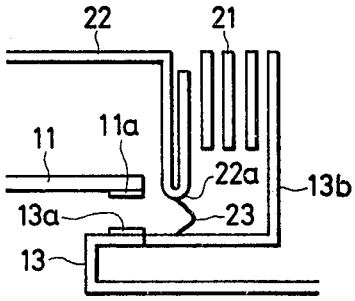
Figure 6B:
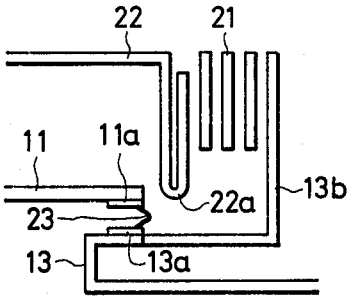
Figure 6E:
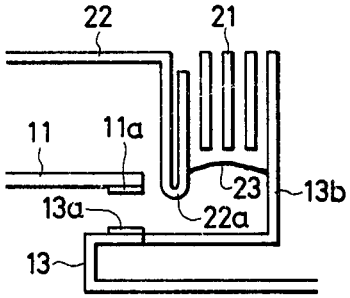
Figure 6C:
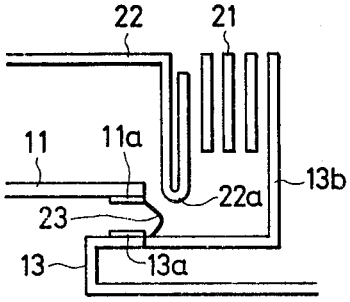
Figure 6F:
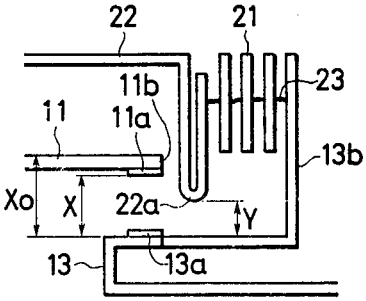

The move of the arc in the power switchgear according to the invention will be described with reference to FIG. 6. FIG. 6*a* represents the state wherein the stationary contact 13*a* and the moving contact 11*a* are closed. When the stationary contact 13*a* and the moving contact 11*a* are opened with the operating coil 5 conducting, the arc 23 is generated, as shown in FIG. 6*b*, between the stationary contact 13*a* and the moving contact 11*a*. The contact opening distance increases with time to a predetermined distance. The arc 23 is driven and expanded, as shown in FIG. 6*c*, by currents flowing through the moving contact-maker 11 and the fixed contact-maker 13, and by the magnetism of the deion grid 21. When X becomes larger than Y as the moving contact 11*a* moves, one end of the arc 23 is transferred, as shown in FIG. 6*d*, from the moving contact 11*a* to the tip 22*a* of the commutating electrode 22. The arc 23 is driven and expanded by the current flowing to the fixed contact-maker 13, the arc runner 13*b* and the commutating electrode 22 and the deion grid 21, as shown in FIG. 6*e*, and the arc 23 is drawn into the deion grid 21 as shown in FIG. 6*f*, *l thus cutting off the current. As described, in the power switchgear according to the invention, since the position of the tip of the commutating electrode is set so that Y in FIG. 6f* will be smaller than X when the moving contact is opened, the time within which one end of the arc is on the moving contact 11*a* is shortened, and thus the wear of this expensive contact can be decreased. The moving contact-maker 11 is surrounded by a poor conductor, and therefore it is heated to a high temperature by the arc when switching is repeated at short time intervals. Consequently, thermal damage of the cross bar 8 to cause breakage thereof can occur in the conventional system. However, the application of the invention prevents such thermal damage to the cross bar, as the time in which the arc is on one end of the moving contact 11*a* is shortened.

The above description refers to the case wherein the distance Y is made smaller than X in FIG. 6*f*. However, a similar effect is obtainable when the relation between $X_0$ in FIG. 6*f*, or the distance between the arc runner 13*b* and the rear face of the moving contact-maker, and Y satisfy $Y < X_0$.

In this case, however, one foot of the arc 23 on the moving contact is transferred to the commutating electrode 22 by way of the tip 11*b* of the moving contact-maker 11.

Figure 7:
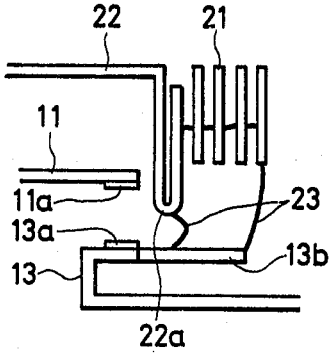
FIG. 7 is an explanatory drawing showing an arc extinguishing chamber of a power switchgear according to the invention and the movement of the arc.
Figure 8:
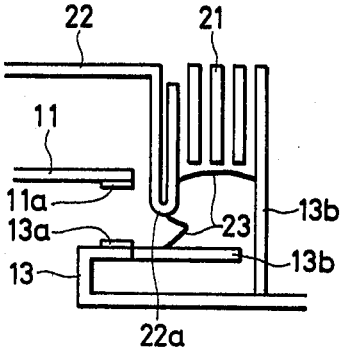
FIG. 8 illustrates a variation of the construction of the arc runner of FIGS. 6 or 7.

In the preferred embodiment shown in FIG. 6, the L-shaped arc runner 13*b* is jointed at the tip of the fixed contact-maker 13, however, a similar effect is obtainable with a non-L-shaped arc runner 13*b* like that of FIG. 7. A similar effect is further obtainable with an arc runner 13*b* divided into two parts as shown in FIG. 8, and having one part connected to the fixed contact-maker 13 at a spot other than the end thereof.

The above embodiment may be applied to a power switchgear operating for switching on a magnet, i.e. an electromagnetic contactor, however, it also supplies to a power switchgear for use as a mold case circuit breaker. The configuration of the arc extinguishing chamber B in such a case is shown in FIG. 9.

Figure 9A:
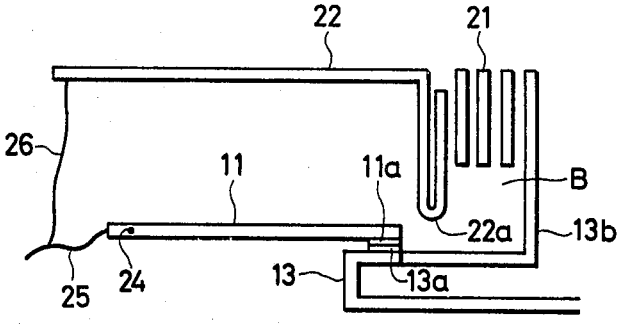
FIGS. 9*a* and 9*b* are closed and opened views of a pivoting type movable contact.
Figure 9B:
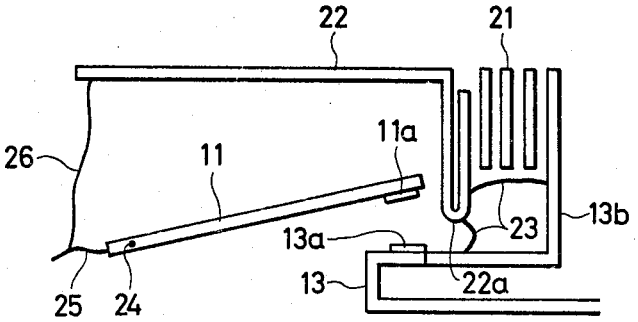

FIG. 9*a* represents the state wherein the stationary contact 13*a* and the moving contact 11*a* are in contact with each other. The moving contact-maker 11 rotates around a rotary shaft 24 through an operating mechanism which is not illustrated. The stationary contact 13*a* and the moving contact 11*a* open as illustrated in FIG. 9*b*. The moving contact-maker 11 and the commutating electrode 22 are connected electrically through wires 25, 26. Since the time during which the arc 23 is kept on the surface of the moving contact 11*a* is short, the wear of the moving contact 11*a* is minimized effectively. The arc 23 is driven by a current flowing to the fixed contact-maker 13 and the commutating electrode 22 and is drawn into the gap between the deion grids 21 quickly. Therefore, the arcing time is shortened and the arc energy is decreased, and thus a large current can be effectively cut off.

Figure 10:
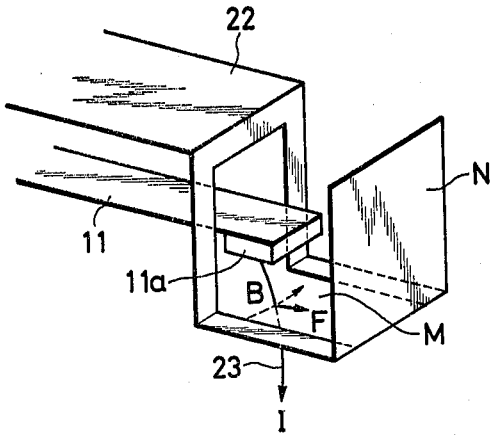
FIGS. 10 and 11*a*–11*f* illustrate a further modified form of the invention using a partially hollow commutating electrode.
Figure 11A:
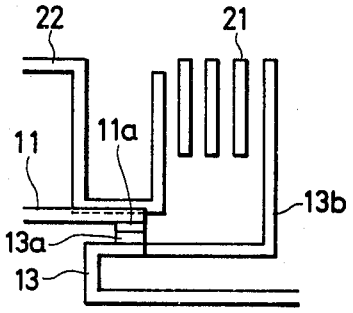
Figure 11D:
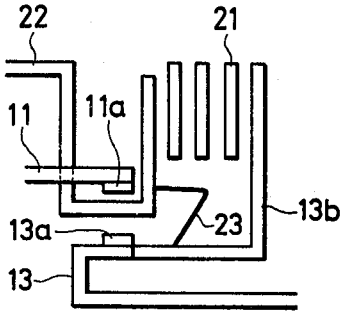
Figure 11B:
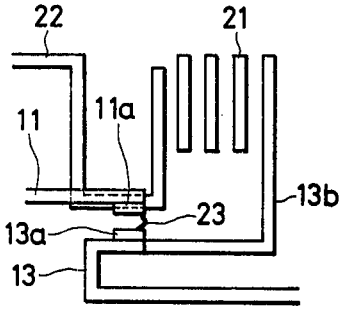
Figure 11E:
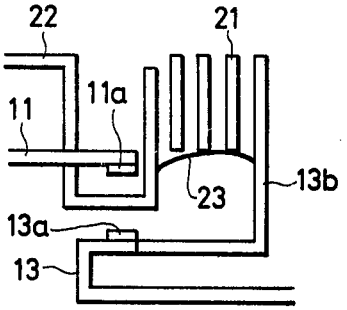
Figure 11C:
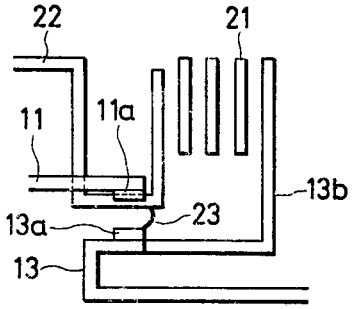
Figure 11F:
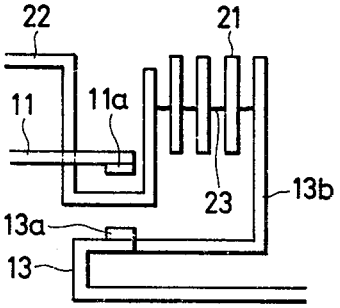

In another embodiment of the invention, M denotes a hollow part of the commutating electrode 22, and N denotes a plane part of the commutating electrode 22, which is arranged so as to be opposite to the deion grid. The shape of the commutating electrode is as shown in FIG. 10. FIG. 10 shows a commutating electrode half, however, since the electrode is symmetrical, the remaining half is identical. The construction is such that the moving contact-maker 11 is capable of moving into a notch of the commutating electrode 22. Namely, when the opening distance of the contacts is maximized, the commutating electrode will be positioned between the contacts. The movement of the arc in the power switchgear according to this embodiment will be described with reference FIG. 11. FIG. 11*a* represents the state wherein the stationary contact 13*a* and the moving contact 11*a* are closed. When the stationary contact 13*a* and the moving contact 11*a* are opened with the operating coil 5 conducting, the arc 23 is generated, as shown in FIG. 11*b*, between the stationary contact 13*a* and the moving contact 11*a*. The arc 23 is driven by a magnetic field produced by a current flowing to the moving contact-maker 11 and the fixed contact-maker 13. The contact opening distance increases up to a predetermined size as time passes. When the contact opening distance becomes larger than the shortest distance between the stationary contact 13*a*, the commutating electrode 22 and the arc runner, one end of the arc 23 is transferred, as shown in FIG. 11c, from the moving contact 11a to the commutating electrode 22. Where a magnetic material is used for the commutating electrode, a strong magnetic field indicated by B in FIG. 10 works upon the arc by the current flowing to the moving contact-maker 11 and the commutating electrode 22. A driving fource F (FIG. 10) is generated in this case to drive the arc strongly, and thus the arc is quickly transferred from the moving contact 11a to the commutating electrode 22 as shown in FIG. 11c. The quickness of the transfer of the arc will vary according to the driving force F and the shape of the commutating electrode. Then, the arc is driven and expanded, as shown in FIG. 11d, by the current flowing to the commutating electrode 22 and the fixed contact-maker 13 and is then extinguished between the deion grids, as shown in FIG. 11f, by way of the state illustrated in FIG. 11e. The current is thereby cut off completely.

As described, in the power switchgear according to the invention, one end of the arc is transferred very quickly from the moving contact to the commutating electrode, therefore the wear of the moving contact is minimized, the arcing time is shortened, and the arc energy is decreased, thereby improving interrupt performance.

Figure 12A:
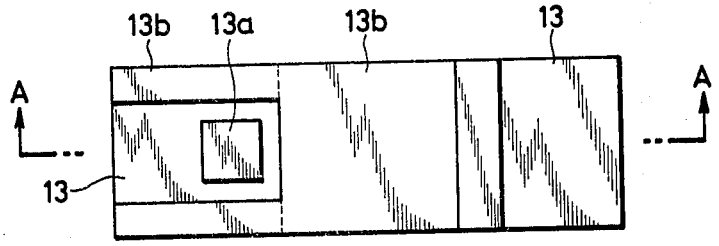
FIGS. 12*a* and 12*b*, 13*a* and 13*b*, 14*a* and 14*b*, and 15*a* and 15*b* are plan and side sectional views, respectively, of different arrangements of the contact, the contact maker and the arc runner according to the invention.
Figure 12B:
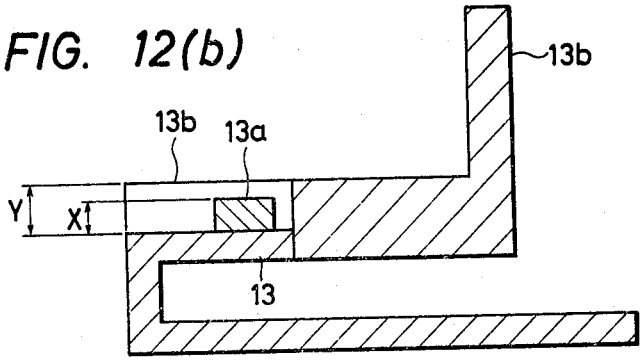
Figure 13A:
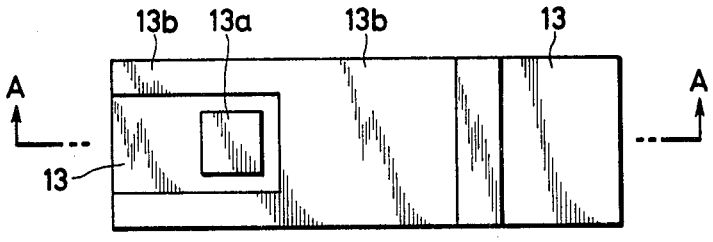
Figure 13B:
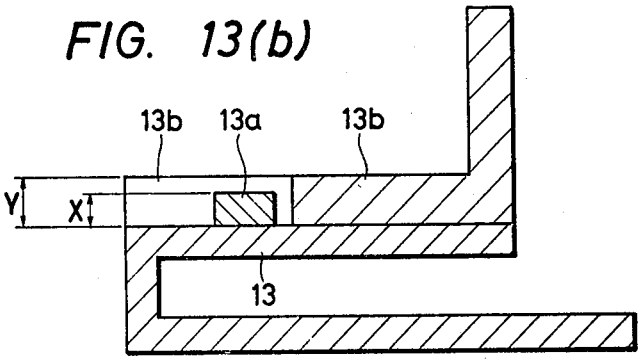
Figure 14A:
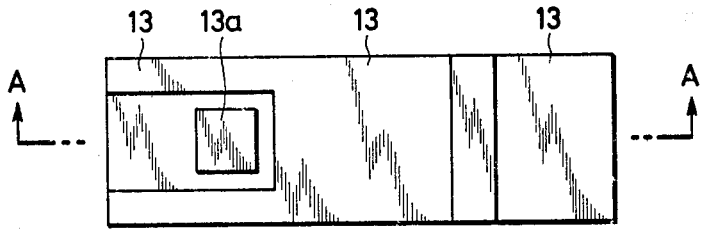
Figure 14B:
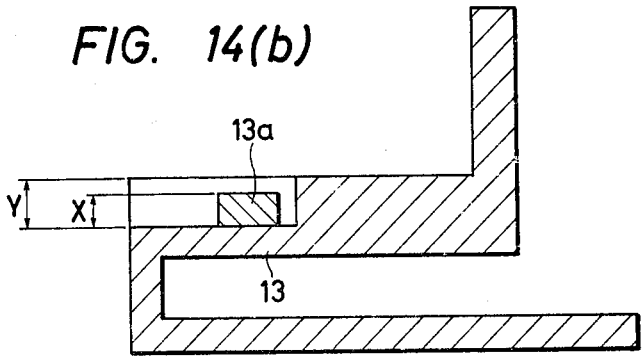
Figure 15A:
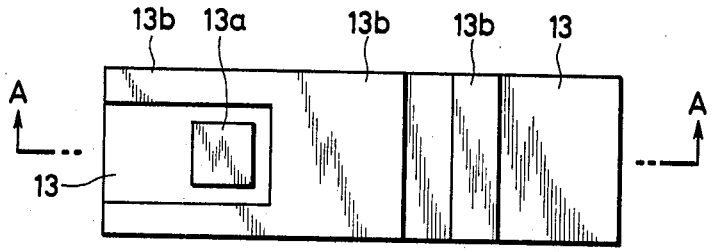
Figure 15B:
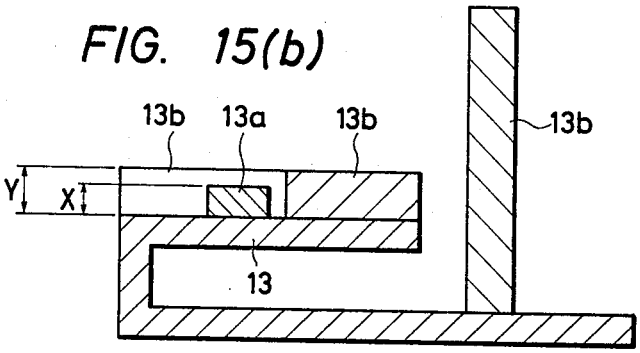

The fixed contact-maker 13 and the arc runner 13b will normally be junctioned as in FIG. 11 but can be joined as in FIG. 12, and further, the arc runner 13b can be placed on the fixed contact-maker 13 as shown in FIG. 13. The fixed contact-maker 13 and the arc runner 13b can also be unified as in FIG. 14, or the arc runner 13b can be divided into two as in FIG. 15. In FIG. 12–FIG. 15, the distance Y from the junction of the stationary contact 13a and the fixed contact-maker 13 to the face of the arc runner 13b which is opposite to the moving contact 11a is set to be larger than the distance X from the junction of the stationary contact 13a and the fixed contact-maker 13 to the surface of the stationary contact 13a. Thus the arc remains on the stationary contact 13a for only a short time, and thus the wear thereof can be decreased accordingly. The structures of FIG. 12–FIG. 15 may be used, for example, with the devices of FIGS. 10 and 11.

Figure 16:
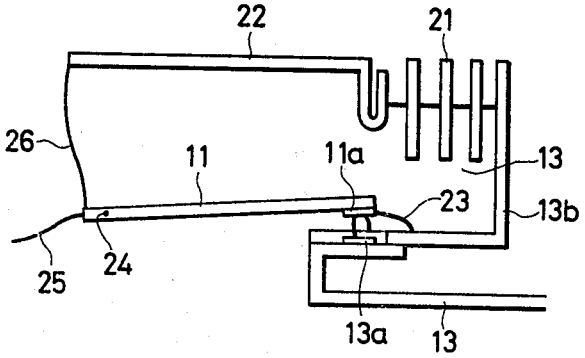
FIG. 16 is a side view of a switchgear illustrating the application of the invention to a mold case circuit breaker.

The above embodiment is used with a power switchgear for a electromagnetic contactor, however, the invention can also apply to a mold case circuit breaker, as is illustrated in FIG. 16. FIG. 16 represents the state wherein the stationary contact 13a and the moving contact 11a are opened. The moving contact-maker 11 operates by rotating about a pin 24 according to an operating mechanism, which is not illustrated. The moving contact-maker 11 and the commutating electrode 22 are connected electrically through the wire 26, and the moving contact-maker 11 is connected to a terminal through a wire 25. The arc is generated at first between the moving contact 11a and the stationary contact 13a, one end of the arc 23 is transferred from the stationary contact 13a to the arc runner 13b, and the arc 23 is finally moved between the commutating electrode and the deion grid 21 and the arc runner 13b, thus interrupting the current. In the power switchgear according to the invention, the time during which one end of the arc 23 is on the stationary contact 13a is kept short, and therefore the wear of the moving contact 11a is effectively decreased, the arcing time is shortened and the arc energy is decreased, to obtain superior interrupt performance.

Figure 17A:
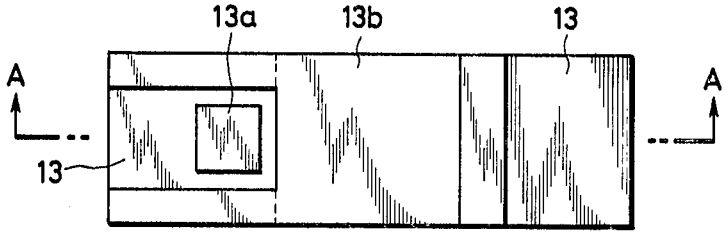
FIGS. 17(*a*) and 17(*b*) are top and cross-sectional side views, respectively, of the switchgear of FIG. 16.
Figure 17B:
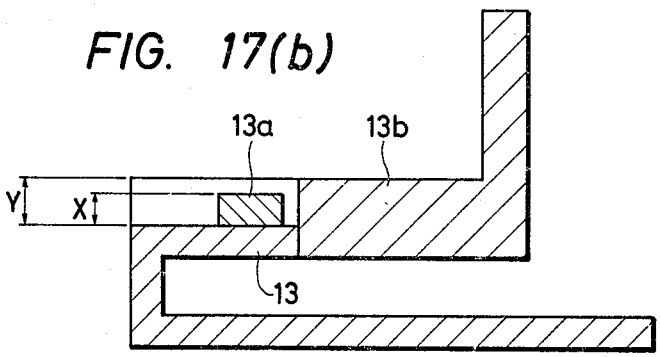

Another construction of the arc runner 13b in FIG. 16 is shown in FIG. 17. FIG. 17a is a top view; FIG. 17b represents a section taken on the line A—A' of FIG. 17a. The arc runner 13b and the fixed contact-maker 13 are joined by means of brazing, and the arc runner 13b has such portion opposite to the moving contact. In FIG. 17b, X denotes the distance from the face at which the stationary contact 13a and the fixed contact-maker 13 are joined to the surface of the stationary contact 13a, and Y denotes the distance from the face at which the stationary contact 13a and the fixed contact-maker 13 are joined to the face of the arc runner 13b which is opposite to the moving contact 11a, Y being larger than X.

Figure 18A:
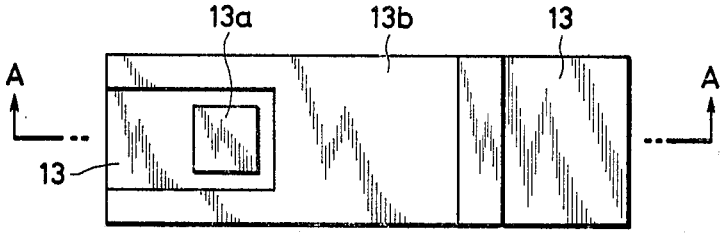
FIGS. 18(*a*) and 18(*b*) are top and cross-sectional side views, respectively, of an embodiment of the invention wherein an arc runner is attached to a fixed contact-maker.
Figure 18B:
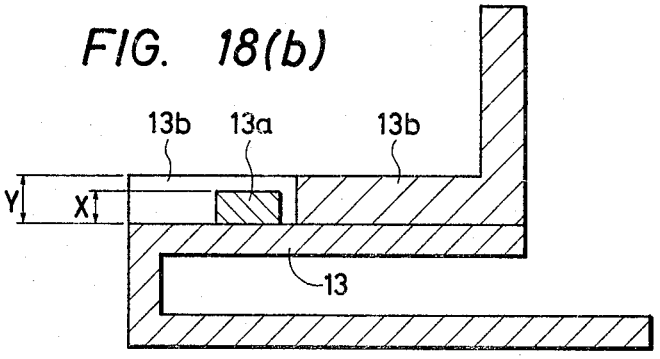
Figure 19A:
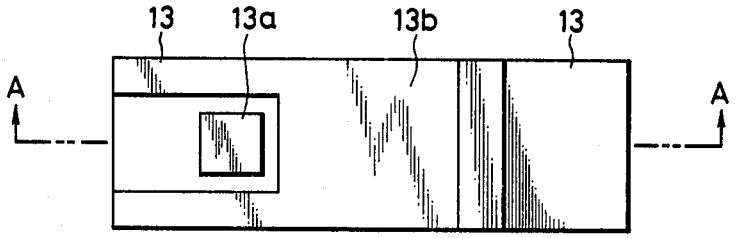
FIGS. 19(*a*) and 19(*b*) are top and cross-sectional side views, respectively, showing one embodiment of the invention wherein the fixed contact-maker and arc runner are unified.
Figure 19B:
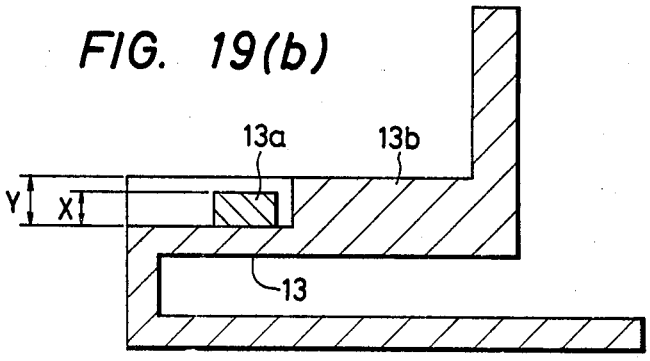
Figure 20A:
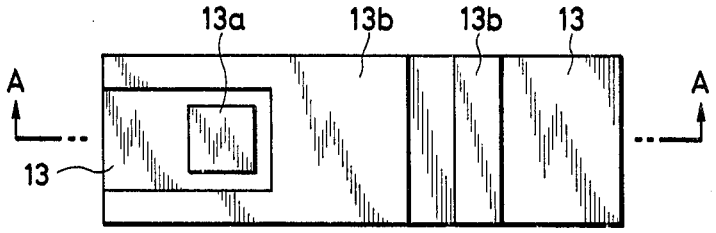
FIGS. 20(*a*) and 20(*b*) are top and cross-sectional side views, respectively, of an embodiment of the invention in which the arc runner is divided in two.
Figure 20B:
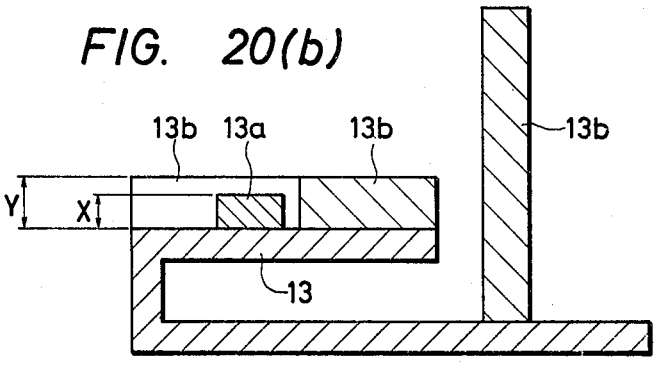

The fixed contact-maker 13 and the arc runner 13b can be constituted as separate units as shown in FIG. 17; the arc runner 13b can be placed and fixed on the fixed contact-maker 13 as shown in FIG. 18; the fixed contact-maker and the arc runner 13b may be unified as in FIG. 19; or the arc runner 13b can be divided into two as shown in FIG. 20. Any of the devices of FIGS. 17–20 is capable of shortening the time during which one end of the arc is on the surface of the stationary contact 13a.

Figure 21:
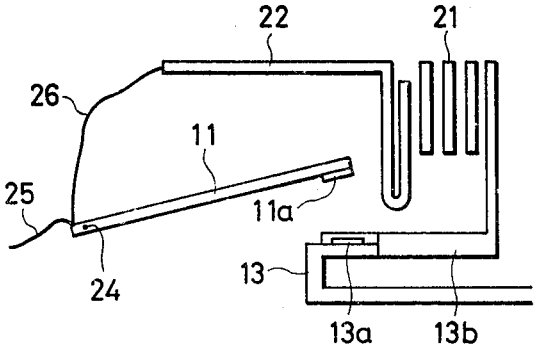
FIG. 21 illustrates an application of the invention to a wiring breaker.

The above embodiment is again used with a power switchgear for an electromagnetic contactor, however, this invention may be applied to a wiring breaker, as illustrated in FIG. 21. FIG. 21 shows the state wherein the stationary contact 13a and the moving contact 11a are opened. The moving contact-maker 11 and the commutating electrode 22 are connected electrically through the wire 26, and the moving contact-maker 11 is connected to a terminal through the wire 25. The arc is first generated between the moving contact 11a and the stationary contact 13a, one end of the arc 23 is transferred from the stationary contact 13a to the arc runner 13b, and the arc 23 is finally moved between the commutating electrode and the deion grid and the arc runner, thus interrupting current. In the power switchgear according to the invention, the time during which the arc is on the surface of the stationary contact 13a and the moving contact 11a can be shortened resulting in the several advantages noted above.

What is claimed is:

1. In a power switchgear equipped with a fixed contact-maker having a stationary contact, a moving contact arranged opposite to said stationary contact joined to a moving contact-maker, an arc runner and a commutating electrode arranged so as to face, when said contacts are closed, a side of said moving contact-maker opposite that to which said moving contact is joined, said moving contact, said arc runner and said commutating electrode being arranged such that the shortest distance between said commutating electrode and said arc runner is smaller than the shortest distance between said opposite side of said moving contact-maker and said arc runner when said contacts are moved apart, the improvement comprising:

at least a portion of said commutating electrode being positioned between a surface of the stationary contact and said opposite side of the moving contact-maker when a distance between said stationary contact and said moving contact is maximized, and having a hollow portion and a planar portion connected to said hollow portion and a deion grid facing said planar portion.

2. The improvement as claimed in claim 1, wherein a distance from a surface at which said stationary contact and said fixed contact-maker are joined to a face of said arc runner opposite said moving contact is larger than a distance from a surface of said moving contact opposite said stationary contact to a contacting surface of said stationary contact.

3. The improvement as claimed in claim 1, wherein the shortest distance between said commutating electrode and said arc runner is less than the shortest distance between a contacting surface of said

4. The improvement as claimed in claim 1, wherein said deion grid is arranged adjacent said commutating electrode, said arc runner is L-shaped and has a portion extending adjacent said grid and a portion engaged with said fixed contact-maker.

5. The improvement as claimed in claim 1, said arc runner including distinct portions arranged at right angles, one portion being attached to said fixed contact-maker, and a second portion being electrically connected to said fixed contact-maker, and said deion grid being arranged adjacent said second portion.

6. The improvement as claimed in claim 1, said arc runner being substantially linear and extending from said fixed contact-maker.

7. The improvement as claimed in claim 1, said fixed contact-maker and said arc runner being integral with each other.

8. The improvement as claimed in claims 1 or 7, said arc runner having a portion arranged on either side of said stationary contact.

9. The improvement as claimed in either claim 1 wherein the shortest distance between said stationary contact and said deion grid is larger than the shortest distance between said stationary contact and said commutating electrode.

* * * * *